US009097415B2

(12) United States Patent
Snijder et al.

(10) Patent No.: US 9,097,415 B2
(45) Date of Patent: Aug. 4, 2015

(54) LIGHTING DEVICE WITH MAGNETICALLY RETAINED LIGHT SOURCE

(75) Inventors: Pieter Jacob Snijder, Valkenswaard (NL); Roel Peter Geert Cuppen, Eindhoven (NL); Jan Alexis Daniel Nesvadba, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 543 days.

(21) Appl. No.: 13/393,930

(22) PCT Filed: Sep. 15, 2010

(86) PCT No.: PCT/IB2010/054165

§ 371 (c)(1), (2), (4) Date: Mar. 2, 2012

(87) PCT Pub. No.: WO2011/036610

PCT Pub. Date: Mar. 31, 2011

(65) Prior Publication Data

US 2012/0176783 A1 Jul. 12, 2012

(30) Foreign Application Priority Data

Sep. 25, 2009 (EP) ..... 09171293

(51) Int. Cl.

| | |
|---|---|
| ***F21V 17/02*** | (2006.01) |
| ***F21S 10/04*** | (2006.01) |
| ***F21V 21/096*** | (2006.01) |
| ***F21S 6/00*** | (2006.01) |
| *F21S 9/02* | (2006.01) |
| *F21Y 101/02* | (2006.01) |

(52) U.S. Cl.

CPC ..... *F21V 21/096* (2013.01); *F21S 6/002* (2013.01); *F21S 6/004* (2013.01); *F21S 9/02* (2013.01); *F21Y 2101/02* (2013.01)

(58) Field of Classification Search

CPC ..... F21L 4/00; F21L 15/06; F21V 23/0414; F21S 9/02; F21Y 2101/02

USPC ..... 362/190, 285, 374

See application file for complete search history.

(56) References Cited

U.S. PATENT DOCUMENTS

| | | | | |
|---|---|---|---|---|
| 2,654,022 | A | 9/1953 | Adamy et al. | |
| 3,292,579 | A | 12/1966 | Buchanan | |
| 5,402,328 | A | 3/1995 | Pardo | |
| 2006/0250798 | A1 | 11/2006 | Herold | |
| 2007/0103917 | A1 | 5/2007 | Wu et al. | |
| 2008/0278958 | A1 * | 11/2008 | Jiang | 362/374 |
| 2009/0086478 | A1 | 4/2009 | Sanroma et al. | |
| 2010/0039792 | A1 * | 2/2010 | Meyers et al. | 362/20 |

FOREIGN PATENT DOCUMENTS

| | | | |
|---|---|---|---|
| FR | 1099212 | A | 3/1954 |
| JP | 63000681 | A | 1/1988 |

(Continued)

*Primary Examiner* — Joseph L Williams

(57) ABSTRACT

A lighting device (1) comprising a base part (2) with a first magnetic material, and a second part (3) is disclosed. The second part comprises a light source (4), and a nonmagnetic shell (5) defining an essentially closed cavity, the light source (4) and the nonmagnetic shell being in a fixed positional relationship, wherein the essentially closed cavity encloses a second magnetic material (6) displaceable therein. This provides a lighting device (1) in which the user may readily position the light source (4) with a large degree of freedom.

9 Claims, 3 Drawing Sheets

(56) References Cited

FOREIGN PATENT DOCUMENTS

| | | | |
|---|---|---|---|
| JP | 3070828 | U | 7/1991 |
| JP | 04156400 | A | 5/1992 |
| JP | 2009087897 | A1 | 7/2009 |
| WO | 2008010498 | A1 | 1/2008 |

* cited by examiner

LIGHTING DEVICE WITH MAGNETICALLY RETAINED LIGHT SOURCE

FIELD OF THE INVENTION

The present invention relates to a lighting device.

BACKGROUND OF THE INVENTION

Lighting devices, in which various parts are held together by use of magnetism, are known. US2009/0086478 discloses a lighting device in the form of a lighting system with removable light modules mounted on a frame by means of the attractive force between magnetic material of the individual light modules and magnetic material of the frame. This allows a light module to be installed on, removed from, or relocated on the frame manually without tools.

Though this known lighting device allows for some flexibility in the user's choice in the positioning of the light modules, it still suffers from the drawback that the light modules only can be installed on the frame according to the predetermined structure of the frame. This, in turn, imposes limitations on the directions, in which the user may choose light to be emitted.

SUMMARY OF THE INVENTION

Based on this prior art it is an object of the present invention to provide a lighting device, which overcomes this drawback, and to provide a more flexible lighting device.

According to a first aspect of the invention, this object is achieved by a lighting device comprising a base part with a first magnetic material, and a second part comprising a light source, and a non-magnetic shell defining an essentially closed cavity, the light source and the non-magnetic shell being in a fixed positional relationship, where the essentially closed cavity encloses a second magnetic material displaceable therein.

This provides a lighting device in which the user may readily position the light source with a large degree of freedom. Since when the second part is moved by the user, the light source follows. Thus, the light from light source can be directed in any wanted position by the user by grabbing and moving the second part with respect to the base part.

The term magnetic material should be construed as a material that is either a permanent magnet or a material that is strongly attracted by a permanent magnet.

This lighting device further has the advantage over lighting devices with a magnetic shell that shells with other optical properties, such like glass, can be used.

For example the first magnetic material may comprise at least one permanent magnet, and the second magnetic material may comprise a ferromagnetic material. Providing only one of the magnetic materials as a permanent magnetic material reduces costs as permanent magnetic materials are generally more expensive than ferromagnetic materials.

The second material may comprise a plurality of elements of ferromagnetic material. This provides for a more flexible adjustment of the ferromagnetic material to the non-magnetic shell, as the ferromagnetic material elements will try to fit the inner side of the non-magnetic shell providing for the minimal distance between the ferromagnetic material and the permanent magnet. Preferably the elements are ball shaped. This provides for an optimum packaging of the elements, as well as for easy displacement of the elements within the closed cavity.

The lighting device may further comprise a battery 8, arranged in the base part 2. For this the base part 2 has a hollow space, serving as a battery compartment, in which the battery 8 is arranged. The battery compartment may be closed by a bottom part 12. The battery 8 serves as the power supply for the electrical devices comprised in second part. The electrical devices comprise e.g. the light source 4. This renders the need for a wire connecting to an external power supply superfluous and thus the lighting device can be placed in various places more easily.

The magnetic force between the first magnetic material and the second magnetic material may be greater than the force of gravity on the base part. This allows the entire lighting device to be lifted by the second part without the base part detaching and dropping, which might be harmful to the base part.

The non-magnetic shell may further comprise a cooling element. The cooling element may be connected to the non-magnetic shell in a fixed manner. The cooling element is arranged to lead heat away from the light source.

The non-magnetic shell may e.g. be at least partially spherical. This provides for the second part to be readily positioned in various spatial angles on the base part.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention. Like numbers refer to like features throughout the drawings.

DETAILED DESCRIPTION

Figure 1:
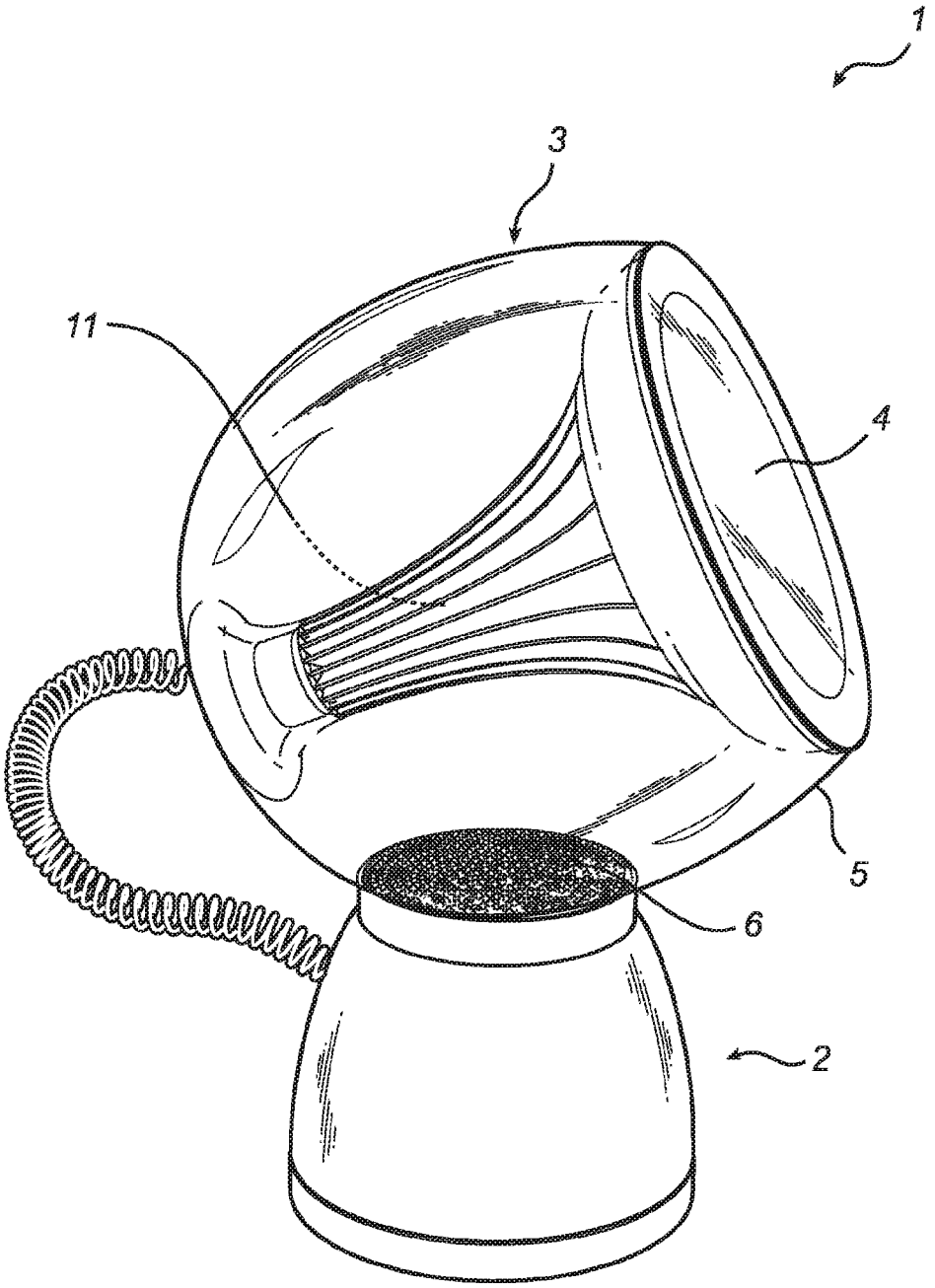
FIG. 1 shows a lighting device according to a preferred embodiment of the invention.

FIG. 1 shows a lighting device 1 according to a preferred embodiment of the invention. The lighting device comprises a base part 2, and a second part 3 having a light source 4. In the illustrated example the light source 4 is in form of at least one light emitting diode (LED). The LEDs may be white, red, blue, amber or green colored or a combination thereof. The LEDs are placed on a Printed Circuit Board (PCB) in the circular front part of the non-magnetic shell 5. A cooling element 11 leads to the PCB, thereby providing cooling of the LEDs.

The second part 3 further comprises a non-magnetic shell 5 defining an essentially closed cavity. The closed cavity is defined by a trumpet-shaped, cooling element 11 surrounded by the non-magnetic shell 5. In this way a torus like cavity is formed. Naturally other ways of forming a closed cavity can be used. It is advantageous to use a rotational symmetrical cavity as this provides for turning the second part 360°.

Preferably the non-magnetic shell 5 is a made of transparent glass, but other materials having suitable optical properties, such as plastic, and translucent glass, may be used. The light source 4 and the non-magnetic shell 5 are in a fixed positional relationship such that when the non-magnetic shell 5 is moved the light source 4 is also moved.

Figure 2:
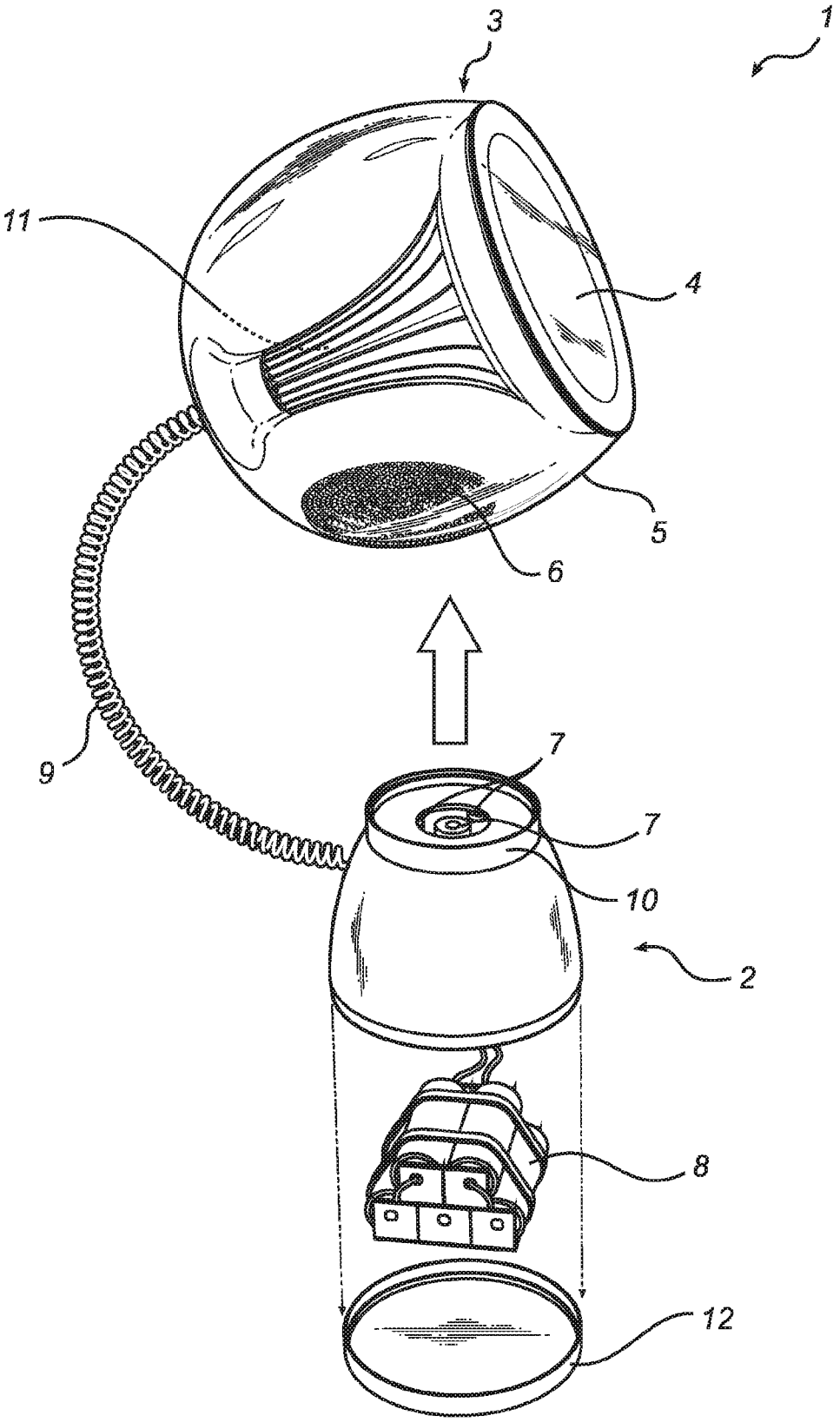
FIG. 2 shows an exploded view of the lighting device of FIG. 1.

FIG. 2 shows an exploded view of the lighting device 1 illustrated in FIG. 1. The lighting device 1 comprises a base part 2 with a first magnetic material 7. The first magnetic material 7 is in form of at least one permanent magnet. Preferably there is more than one permanent magnet. In the illustrated example one permanent magnet is arranged in the center surrounded by a number of other permanent magnets, preferably in a circumferential pattern, such as one permanent magnet surrounded by six permanent magnets. The pattern may e.g. be a circle, a square, a hexagon or any other polygon. It is also possible to use only one permanent magnet that has the shape e.g. of a circle. Alternatively a number of permanent magnets are arranged in a circle, a square, a hexagon or any other polygon.

The essentially closed cavity encloses a second magnetic material 6 displaceable therein. This provides for a flexible adjustment of the second part 3. In the illustrated example the second magnetic material 6 comprises a plurality of elements of ferromagnetic material. The plurality of ferromagnetic material elements will try to fit the inner side of the non-magnetic shell providing for the minimal distance between the ferromagnetic material 6 and the permanent magnet 7. Preferably the elements are ball shaped, this provides for an optimum packaging of the elements, as well as for easy displacement within the closed cavity. Naturally the elements may have other shapes such as cubes, or any other three-dimensional shape. In order to reduce friction a lubricant can be added to the elements. The ferromagnetic material comprises iron e.g. in the form of iron or steel balls. Alternatively, the non-magnetic shell 5 comprises a magnetic material in a fixed shape, e.g. that of a spherical cap. That is, part of its form follows a part of the inner side of the non-magnetic shell 5. For example, if the non-magnetic shell 5 is essentially spherical, part of the magnetic material will be curved in a form following the inner side of the sphere. The curved part of the magnetic material is e.g. supported by at least three possibly non-magnetic bearing balls. The bearing balls are rotatable embedded in the magnetic material. The bearing balls may be lubricated in order to facilitate the displacement of the magnetic material.

Figure 3:
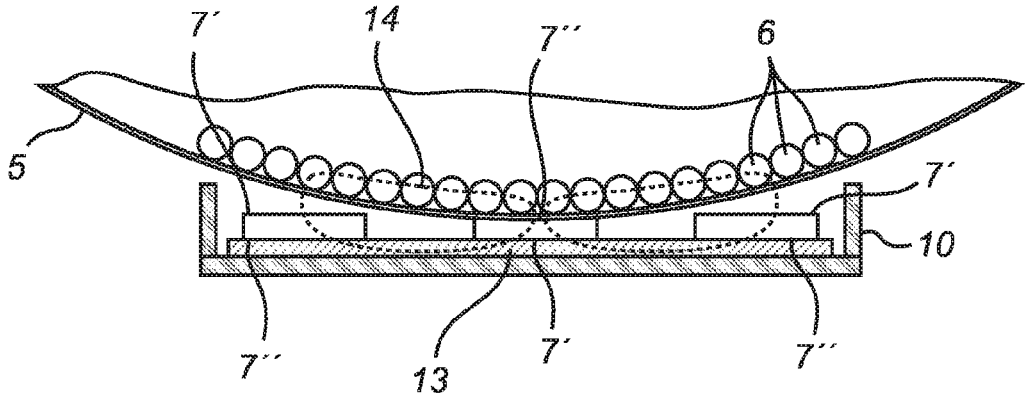
FIG. 3 shows a cross section of part of the lighting device of FIG. 1.

In a preferred embodiment the first magnetic material 7 comprises at least one permanent magnet and the second magnetic material 6 comprises a ferromagnetic material. The arrangement of the first and second material is shown in greater detail in FIG. 3. The arrangement comprises a bottom plate 13, preferably made of iron, with a ring 10 arranged on top of it. On top of the bottom plate 13 a number of magnets 7 are arranged. The permanent magnets are separated from the second magnetic material 6 by the non-magnetic shell 5. The permanent magnet in the center has its magnetic north pole 7" facing down towards the bottom plate 13 and its magnetic south pole 7" facing up toward the second magnetic material 6. The surrounding permanent magnets are arranged in an opposite manner such that their magnetic south pole 7" faces down towards the bottom plate 13 and their magnetic north pole faces up toward the second magnetic material 6. In this way the bottom plate acts as a magnetic path, and a magnetic field 14 is created, thereby creating a pseudo pot magnet. Obviously the permanent magnets could be arranged the other way around such that the permanent magnet in the center has its magnetic south pole facing down towards the bottom plate 13 and its magnetic north pole facing up toward the second magnetic material 6. Likewise the surrounding permanent magnets would then be arranged in an opposite manner such that their magnetic north pole faces down towards the bottom plate 13 and their magnetic south pole faces up toward the second magnetic material 6. It is preferred to use a pot magnet, since this will create a strong magnetic field, but it is rather expensive so alternatively a pseudo pot magnet can be used by arranging a number of permanent disk magnets onto an iron plate so as to form the bottom part of the pseudo pot magnet, e.g. as in one of the examples of the arrangement of the permanent magnets explained above.

Alternatively the first magnetic material 7 comprises a ferromagnetic material and the second magnetic material 6 comprises at least one permanent magnet. This is especially advantageous when the second magnetic material 6 is one piece of material such as a spherical cap.

The lighting device 1 further comprises a battery 8, arranged in the base part 2. The battery serves as the power supply for the electrical devices comprised in second part. The electrical devices comprise e.g. the light source 4. The base part 2 with the battery 8 is electrical connected with the light source 4 in the second part 3 via a wire 9. This is advantageous as the base part 2 and the second part 3 in this way are connected, such that one of the parts is not mislaid. Alternatively the battery 8 can be arranged in the second part. In this way there is no need of a wire between the base part 2 and the second part 3. Also the power between the battery 8 and the light source 4 can be transmitted by magnetic induction e.g. by use of inductors, e.g. induction coils, thereby rendering the need for a wire superfluous. This furthermore provides for various base parts to be used together with the one and the same second part 2.

In the illustrated example the magnetic force between the first magnetic material 7 and the second magnetic material 6 is greater than the force of gravity on the base part 2, such that when the second part 3 is lifted the base part 2 follows without the two parts detaching and dropping, which may be harmful.

In order to facilitate detachment of the base part 2 from the second part 3 a mechanical lever may be implemented, such that only a small gap between the base part 2 and the second part 3 can be created in order to separate both parts easily. In an embodiment one end of the lever is placed below the non-magnetic shell 5 of the second part 3, and the other end of the lever is placed outside of the base part 2. In this way only a small gap between the non-magnetic shell 5 and the base part 2 has to be created in order to separate both parts easily, assuming that the magnetic force between the base part 2 and the non-magnetic shell 5 decreases more than linearly with the distance between the two parts. For example, the lever may be arranged such that pivoting the lever causes the non-magnetic shell 5 to be tilted a few millimeters. Alternatively at least one electro magnet is used, such that when the power is disconnected the magnetic force between the base part 2 and the second part 3 disappears, thereby facilitating the separation of the base part 2 and the second part 3. Instead the magnetic material may comprise at least one electro magnet that when power is turned on creates a reverse electromagnet, thereby neutralizing the magnetic attraction or even pushing the first and the second magnetic material away from each other if they are both permanent magnets.

The non-magnetic shell 5 comprises a cooling element 11. Here the non-magnetic shell 5 comprises the cooling element 11 connected thereto in a fixed manner. Furthermore the light source 4 is connected to the non-magnetic shell 5 in a fixed manner. Preferably the non-magnetic shell 5 is at least partially spherical. This provides for the second part to be readily positioned in various spatial angles on the base part. A portion of the spherical part of the non-magnetic shell 5 is in contact with a ring 10, such as a plastic ring 10, comprised in the base part 2. This facilitates turning the non-magnetic shell 5 in various directions.

The person skilled in the art realizes that the present invention by no means is limited to the preferred embodiments described above. On the contrary, many modifications and variations are possible within the scope of the appended claims.

The invention claimed is:

1. A lighting device, comprising:

a base part comprising a first magnetic material, and a second part comprising:

a light source, and a non-magnetic shell defining an essentially closed cavity, the light source and the non-magnetic shell being in a fixed positional relationship, the essentially closed cavity enclosing a second magnetic material displaceable therein;

wherein said first magnetic material comprises at least one permanent magnet and said second magnetic material comprises a ferromagnetic material.

2. The lighting device according to claim 1, wherein the second material comprises a plurality of elements of ferromagnetic material.

3. The lighting device according to claim 2, wherein the elements are ball shaped.

4. The lighting device according to claim 1, further comprising a battery, arranged in the base part.

5. The lighting device according to claim 1, wherein the magnetic force between the first magnetic material and the second magnetic material is greater than the force of gravity on the base part.

6. The lighting device according to claim 1, wherein the non-magnetic shell comprises a cooling element.

7. The lighting device according to claim 1, wherein the non-magnetic shell is at least partially spherical.

8. A lighting device, comprising:

a base part comprising a first magnetic material, a second part including a light source, and a non-magnetic shell defining an essentially closed cavity, the light source and the non-magnetic shell being in a fixed positional relationship, the essentially closed cavity enclosing a plurality of a second magnetic material and being displaceable in the shell;

wherein at least one of the first magnetic material and the second magnetic material includes at least one permanent magnet and at least one of the first magnetic material and the second magnetic material includes a ferromagnetic material.

9. A lighting device, comprising:

a base part comprising a first magnetic material, a second part including a light source, and a non-magnetic shell defining an essentially closed cavity, the light source and the non-magnetic shell being in a fixed positional relationship, the essentially closed cavity enclosing a second magnetic material displaceable therein;

wherein at least one of the first magnetic material and the second magnetic material includes at least one permanent magnet and at least one of the first magnetic material and the second magnetic material includes a ferromagnetic material.

* * * * *